US007121884B2

(12) United States Patent
Osada

(10) Patent No.: US 7,121,884 B2
(45) Date of Patent: Oct. 17, 2006

(54) ELECTRICAL CONNECTING DEVICE

(75) Inventor: Tsuyoshi Osada, Nishikamo-gun (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/166,045

(22) Filed: Jun. 24, 2005

(65) Prior Publication Data

US 2006/0014428 A1 Jan. 19, 2006

(30) Foreign Application Priority Data

Jun. 25, 2004 (JP) ..... 2004-187336

(51) Int. Cl.
*H01R 9/05* (2006.01)
*H01R 13/58* (2006.01)

(52) U.S. Cl. ..... 439/582; 439/466

(58) Field of Classification Search ..... 439/582, 439/579, 578, 607, 466, 135, 417
See application file for complete search history.

(56) References Cited

U.S. PATENT DOCUMENTS 5,194,020 A * 3/1993 Voltz ..... 439/579
5,697,806 A * 12/1997 Whiteman et al. ..... 439/417
5,855,493 A * 1/1999 Shelly ..... 439/465
5,906,511 A * 5/1999 Bozzer et al. ..... 439/579
6,250,952 B1 * 6/2001 Shiga et al. ..... 439/466
6,358,062 B1 * 3/2002 Feldman et al. ..... 439/63
6,547,593 B1 * 4/2003 Beckous ..... 439/581
6,551,137 B1 * 4/2003 Pfaff et al. ..... 439/607

* cited by examiner

*Primary Examiner*—Hien Vu
(74) *Attorney, Agent, or Firm*—Osha Liang LLP

(57) ABSTRACT

A terminal connection part 14 that is connected to a to-be-connected terminal, a wire connection part 15 on a side opposite the terminal connection part 14, and a bent part 16 between the terminal connection part 14 and the wire connection part 15 are provided to each of the connection terminals 11 of four or more poles. A connecting housing element 12 has a terminal supporting part 22 that supports each connection terminal 11 so that the terminal connection parts 15 are arranged in a parallel manner in rectilinear form and are connected to the to-be-connected terminals. The connecting housing element 12 additionally has a wire supporting part 19 that supports the electric wires 3 so that the electric wires 3 are led out in a direction parallel to the linear arrangement direction of the terminal connection parts 14. The wire supporting part 19 supports the electric wires 3 so that the electric wires 3 connected to the front-side connection terminals 11 are arranged in such a curved manner as to detour the periphery of the leading-side connection terminals 11. The connecting housing element 12 is connected to the to-be-connected housing element 2 by being fitted therewith.

14 Claims, 12 Drawing Sheets

ELECTRICAL CONNECTING DEVICE

BACKGROUND OF THE INVENTION

1. Field of the Invention

The present invention relates to an electrical connecting device that is connected to a to-be-connected housing element, which supports to-be-connected terminals of four or more poles which are arranged in rectilinear form.

2. Background Art

An electrical connecting device for connecting a to-be-connected housing element, which supports to-be-connected terminals of four or more poles arranged side-by-side, has been conventionally known. Japanese Published Unexamined Patent Application No. H11-251002, for example, discloses a coaxial connector having a number of cores which is formed of a plug coupling part and a receptacle coupling part as a connector that includes the above-described electrical connecting device. In this coaxial connector, the plug coupling part is provided with four poles of the first central contacts and the first external contacts, and these four pole contacts are arranged in a parallel manner in rectilinear form. In the receptacle coupling part, four pole second central contacts and second external contacts which are respectively electrically connected to the four pole contacts on the plug coupling part side are arranged side-by-side, at points which respectively correspond to the four pole contacts on the plug coupling part side. Thus, four coaxial cables which correspond to and are connected to the respective contacts lead out in a straight line on the side opposite the side where the four pole contacts on either side, the plug coupling part side or the receptacle coupling part side, are respectively connected in the arrangement.

In the coaxial connector that is described in Japanese Published Unexamined Patent Application No. H11-251002, however, the coaxial cable that leads out from a housing element on either the plug coupling part side or the receptacle coupling part side is arranged so as to lead out in a direction perpendicular to a direction in which the housing element is arranged. Therefore, in either housing element, the size of the housing element may become too large, depending on the pitch between the poles which are arranged side-by-side.

Accordingly, there is some spatial restriction, due to the size of the housing elements when each connector is worked on so as to be connected. That is, it brings disadvantages when working on a connection within a limited space or through such a space, like working in a narrow space.

This is disadvantageous particularly in the case where a to-be-connected housing element that supports to-be-connected terminals of four or more poles which are arranged in a rectilinear form, and an electrical connecting device having a connecting housing element, that supports connection terminals of four or more poles which are electrically connected to the to-be-connected terminals, respectively, are connected to each other after this electrical connecting device has been inserted into a hole formed in a wall. That is, the size of the electrical connecting device that is inserted into a through-hole formed in a wall restricts the size of the through-hole, or makes the insertion work of the electrical connecting device difficult.

SUMMARY OF THE INVENTION

In view of the above-described situation, an object of the present invention is to provide a compact electrical connecting device that can reduce the disadvantage of the dimensional restriction in the case where a to-be-connected housing element that supports to-be-connected terminals of four or more poles arranged in rectilinear form and an electrical connecting device having a connecting housing element that supports connection terminals of four or more are connected to each other.

The present invention relates to an electrical connecting device for connecting a to-be-connected housing element that supports to-be-connected terminals of four or more poles arranged in rectilinear form.

Thus, the present invention is characterized by several points, as described below, in order to achieve the above-described object. That is, the present invention has any of the below described features, either by themselves or in an appropriate combination.

A first feature of the electrical connecting device of the present invention to achieve the object is that the electrical connecting device comprises: connection terminals of four or more poles adapted to be electrically connected to the to-be-connected terminals of four or more poles, respectively; and a connecting housing element adapted to connect to the to-be-connected housing element. Each of the connection terminals includes a terminal connection part adapted to be connected to the to-be-connected terminal, a wire connection part adapted to be connected to an electric wire at an end opposite the terminal connection part, and a bent part bent between the terminal connection part and the wire connection part. The connecting housing element includes a terminal supporting part that supports each of the connection terminals so that the terminal connection parts are arranged in rectilinear form and are connected to the to-be-connected terminals, respectively, and a wire supporting part that supports each of the electric wires so that the electric wires connected to the wire connection parts are led out in a longitudinal direction of the connecting housing element in which the terminal connection parts are arranged. The wire supporting part supports the electric wire so that the electric wire connected to a front-side connection terminal, which is one of the connection terminals adjacent to each other, disposed on a front side of the connecting housing element can be arranged in such a curved manner so as to detour the periphery of the bent part of a rear-side connection terminal adjacent to the front-side connection terminal.

According to this configuration, the connection terminal has the bend part between the terminal connection part and the wire connection part, and the electric wire connected to the wire connection part is led out in the longitudinal direction of the connecting housing element. The electric wire connected to the front-side connection terminal is arranged in such a curved manner so as to detour the periphery of the bent part of the rear-side connection terminal. Therefore, the electric wires can be bundled in the parallel direction, and can be efficiently gathered without interference with the leading-side connection terminals, and hence a space to arrange the electric wires can be concentrated. In other words, it is possible to efficiently prevent the fact that the electrical connecting device becomes large depending on the pitch where the terminal connection parts are arranged in parallel, and, accordingly, the electrical connecting device can be reduced in size. This is advantageous in assembling work within a limited space like a narrow space. Since the electrical connecting device is slender in the longitudinal direction of the connecting housing element, a great advantage can be obtained especially when a hole formed in the wall surface is connected to another member after the electrical connecting device is passed therethrough. In other words, the size of the hole can be reduced, and the electrical connecting device can be easily passed therethrough.

Additionally, since the electric wires can be efficiently gathered without interference between the electric wires connected to the front-side connection terminals and the rear-side connection terminals, it is possible to ease dimensional restrictions on the arrangement of the front-side connection terminals and the leading-side connection terminals that adjoin each other. That is, since an interval between the front-side connection terminal and the rear-side connection terminal can be shortened, it is possible to achieve a size reduction in the longitudinal direction, and it is possible to increase the design freedom of the wire connection part of the front-side connection terminal, and it is possible to ease the fact that the electric wire connected to the wire connection part of the front-side connection terminal is bent.

Therefore, it is possible to provide a small-sized electrical connecting device that can ease a disadvantage resulting from dimensional restrictions on a connection between the to-be-connected housing element that supports the to-be-connected terminals of four or more poles arranged in rectilinear form and the electrical connecting device that has the connecting housing element supporting the connection terminals of four or more poles.

A second feature of the electrical connecting device of the present invention is that the bent part is bent at a right angle.

According to this configuration, it is possible to diminish the distance between the straight line along which the terminal connection parts are arranged in parallel and the electric wire that is connected to the wire connection part and that is arranged in parallel with the straight line. That is, a slenderer shape extending in the direction in which the terminal connection parts are arranged can be formed, and the electrical connecting device can be made more compact.

A third feature of the electrical connecting device of the present invention is that the terminal supporting part supports the front-side connection terminal so that an direction of the wire connection part of the front-side connection terminal deviates obliquely from the longitudinal direction of the connecting housing element.

According to this configuration, since the direction of the wire connection part is deviated obliquely from the longitudinal direction of the connecting housing element, a space in the width direction inside the electrical connecting device can be effectively utilized, and the electric wires can be more efficiently gathered without interference between the electric wires connected to the front-side connection terminals and the rear-side connection terminals.

A fourth feature of the electrical connecting device of the present invention is that the electric wire that is connected to at least one of the front-side connection terminals is supported to be arranged in such a curved manner so as to detour the periphery of the bent part of the rear-side connection terminal at different heights off the surface of the connecting housing element.

According to this configuration, the electric wire connected to the front-side connection terminal is arranged in such a curved manner so as to detour the periphery of the leading-side connection terminal at different heights off the surface of the connecting housing element. Therefore, interference can be avoided between the electric wire connected to the front-side connection terminal and the rear-side connection terminal, and the electric wires can be efficiently gathered together even in a space on the surface of the connecting housing element. Therefore, it is possible to achieve a greater reduction of dimensional restrictions on the arrangement of the front-side connection terminal and the rear-side connection terminal that adjoin each other.

A fifth feature of the electrical connecting device of the present invention is that the wire supporting part further has a stacking supporting part that supports each electric wire so that electric wires each connected to the wire connection part are stacked, and the electric wire disposed as an upper one at the stacking supporting part is arranged in such a curved manner so as to detour the periphery of the bent part of the leading-side connection terminal at different heights off the surface of the connecting housing element.

According to this configuration, since the electric wires that are connected to the wire connection parts and that are arranged in a parallel manner can be disposed so as to stack the cross-sections thereof, the electric wires can be more densely bundled in the parallel direction. Additionally, since the upper one of the electric wires stacked thereon is disposed in such a curved manner so as to detour the periphery of the leading-side connection terminal at different heights off the surface of the connecting housing element, the electric wires can be efficiently gathered without interference between the electric wires connected to the front-side connection terminals and the rear-side connection terminals when the upper electric wire is disposed in such a manner as to be drawn around.

A sixth feature of the electrical connecting device of the present invention is that the wire supporting part further has a curved supporting part that supports the electric wire connected to at least one of the front-side connection terminals so as to be arranged in such a curved manner so as to detour the periphery of the bent part of the leading-side connection terminal at different heights off the connecting housing element.

According to this configuration, since the curved supporting part is provided, the electric wire connected to the front-side connection terminal can be stably supported without being moved when the electric wire connected to the front-side connection terminal is disposed in such a curved manner so as to detour the periphery of the leading-side connection terminal at different heights off the connecting housing element.

A seventh feature of the electrical connecting device of the present invention is that the curved supporting part further has a step part having a plurality of steps protruding from the connecting housing element so that the steps become higher in order.

According to this configuration, since the step part having a plurality of steps that become higher step by step is provided, the electric wire can be disposed, smoothly rising upward. Additionally, the curved supporting part can be easily formed by a simple structure that the step part having a plurality of steps is provided.

An eighth feature of the electrical connecting device of the present invention is that the curved supporting part further has a slope part having a slant surface.

According to this configuration, since the slope part having a slant surface ascending is provided, the electric wires can be arranged, smoothly rising upward. Additionally, the curved supporting part can be easily formed with a simple structure that the slope part is provided.

A ninth feature of the electrical connecting device of the present invention is that the curved supporting part further has a curved wall surface that protrudes upward and that has a curved surface portion coming into contact with the electric wire.

According to this configuration, since the curved wall surface is provided, the electric wire can be disposed in such a smoothly curved manner so as to detour the periphery of the leading-side connection terminal at different heights off the surface of the connecting housing element by disposing the electric wire connected to the front-side connection terminal along the curved wall surface. Additionally, the electric wire that is disposed in a curved manner can be stably supported without movement.

A tenth feature of the electrical connecting device of the present invention is that the wire supporting part further has a plurality of projection parts that protrude from the connecting housing element and that support the electric wire by fitting the electric wire between a pair of projection parts that face each other, and the wire supporting part further has convex parts that are formed on mutually facing surfaces of the pair of projection parts, respectively, and that protrude inwardly from the mutually facing surfaces.

According to this configuration, the electric wires can be supported merely by providing the projection parts on the connecting housing element and by fitting the electric wires between the pair of projection parts that face each other. Therefore, the wire supporting part can be easily formed. Additionally, since the convex part is formed on each facing surface between the projection parts, the electric wire fitted between the projection parts can be stably supported by the convex part.

An eleventh feature of the electrical connecting device of the present invention is that the convex part is formed in a semicircular shape in cross-section.

According to this configuration, the electric wires can be supported by the mutually closest portions between the convex parts nearly in a line contact state, and the electric wires can be held with a greater force. Additionally, since the convex part is formed in a semicircular shape in cross-section, the electric wires can be prevented from being flawed by the convex part.

A twelfth feature of the electrical connecting device of the present invention is that the electrical connecting device further comprises a cover element adapted to be attached to the connecting housing element so as to cover the connection terminals. The cover element has a cover-side engagement part on an inner surface of the cover element, and the connecting housing element has a housing-side engagement part adapted to engage the cover-side engagement.

According to this configuration, the cover-side engagement part is provided on the inner surface of the cover element, and the housing-side engagement part is provided on the surface of the connecting housing element opposite the inner surface of the cover element. Therefore, when the cover-side engagement part and the housing-side engagement part are engaged with each other, and then the cover element is attached to the connecting housing element, neither the cover-side engagement part nor the housing-side engagement part can be exposed outward. Therefore, a mechanism to make an engagement between the cover element and the connecting housing element can be prevented from interfering with an external member and from being damaged.

A thirteenth feature of the electrical connecting device of the present invention is that the cover-side engagement part has a leg part that protrudes from the inner surface of the connecting housing element and a latching part that further protrudes from the leg part. The housing-side engagement part has a hole part that has an engagement concave part hollowed so as to be engaged with the latching part.

According to this configuration, the provision of the leg part having the latching part of the cover element and the formation of the hole part having the engagement concave part in the connecting housing element make it possible to easily form the mechanism to make an engagement between the cover element and the connecting housing element so as to have a simple structure without being exposed outward.

A fourteenth feature of the electrical connecting device of the present invention is that the electrical connecting device further comprises a cover element that is attached to the connecting housing element so as to cover the connection terminals. The cover element and the connecting housing element have positioning parts, respectively, for positioning by being engaged with each other at least either on the front side or on the rear side.

According to this configuration, in order to attach the cover element to the connecting housing element, the positioning parts formed either on the front side or on the rear side are first engaged with each other, and thereby the cover element and the connecting housing element can be easily positioned. Therefore, the cover element can be promptly attached without a positional disagreement between the connecting housing element and the cover element. Additionally, since positioning can be performed at once when the cover element is attached to the connecting housing element, the cover element can be prevented from being improperly attached to the connecting housing element by mistake. Further, the occurrence of damage or the like resulting from the incorrect attachment in a deviated position can be prevented.

A fifteenth feature of the electrical connecting device of the present invention is that the positioning part includes a first elongated protrusion or a first groove provided on the cover element and a second groove that is engaged with the first elongated protrusion or a second elongated protrusion that is engaged with the first groove, and the second groove and the second elongated protrusion are provided on the connecting housing element.

According to this configuration, since the positioning part is formed of the groove and the elongated protrusion that are engaged with each other, the positioning of the cover element and the connecting housing element by using the positioning part makes it possible to prevent the cover element from being attached in a state of being twisted with respect to the connecting housing element.

A sixteenth feature of the electrical connecting device of the present invention is that a front part of the cover element on the extreme side is formed in a tapered shape toward the front side to cover the front side of the connecting housing element to which the cover element is attached. In the cover element, the first elongated protrusion or the first groove is formed on a first sliding surface to be covered while being slid onto the front side of the connecting housing element of the front part, whereas, in the connecting housing element, the second groove or the second elongated protrusion is formed on a second sliding surface that is slid onto the first sliding surface on the front side of the connecting housing element.

According to this configuration, since the front part of the cover element covers the front side of the connecting housing element and is tapered toward its tip, the cover element can be smoothly and easily inserted into a through-hole when the electrical connecting device is inserted into the through-hole and is then connected to the connecting housing element. Additionally, since the first elongated protrusion or the first groove is formed on the first sliding surface of the cover element and since the second groove or the second elongated protrusion is formed on the second sliding surface of the connecting housing element, it is possible to easily form a positioning part that can prevent the cover element from being attached in a state of being twisted with respect to the connecting housing element.

A seventeenth feature of the electrical connecting device of the present invention is that the electrical connecting device is used as an electrical connecting device that is first inserted into a through-hole formed to insert the electric wires between the inside and outside of a vehicle, and is then connected to the to-be-connected housing element.

According to this configuration, the electrical connecting device can be easily inserted into the through-hole formed to insert the electric wires between the inside and outside of a vehicle, and the size of the through-hole can be reduced.

The above-mentioned and other objects, features, and advantages of the present invention will become apparent by reading the following description with reference to the attached drawings.

DETAILED DESCRIPTION

The best mode for carrying out the present invention will be hereinafter described with reference to the drawings. Although a description is given of an electrical connecting device that is connected to a to-be-connected housing element which supports to-be-connected terminals of four poles (four pieces) according to this embodiment, the present invention is applicable in a case in which the to-be-connected housing element supports to-be-connected terminals of five or more poles. In other words, the present invention can be widely applied to an electrical connecting device that is connected to a to-be-connected housing element which supports to-be-connected terminals of four or more poles which are arranged in rectilinear form.

The present invention is especially suitable for use as an electrical connecting device that is connected to a to-be-connected housing element after the electrical connecting device is inserted into a through-hole formed to pass an electric wire therethrough between the outside and the inside of a vehicle. This use is taken as an example and is described in this embodiment. However, the present invention can be applied even in a case in which the electrical connecting device is used other than this use, and can be more widely applied. That is, the present invention can be applied in many different environments and for various purposes.

Figure 1:
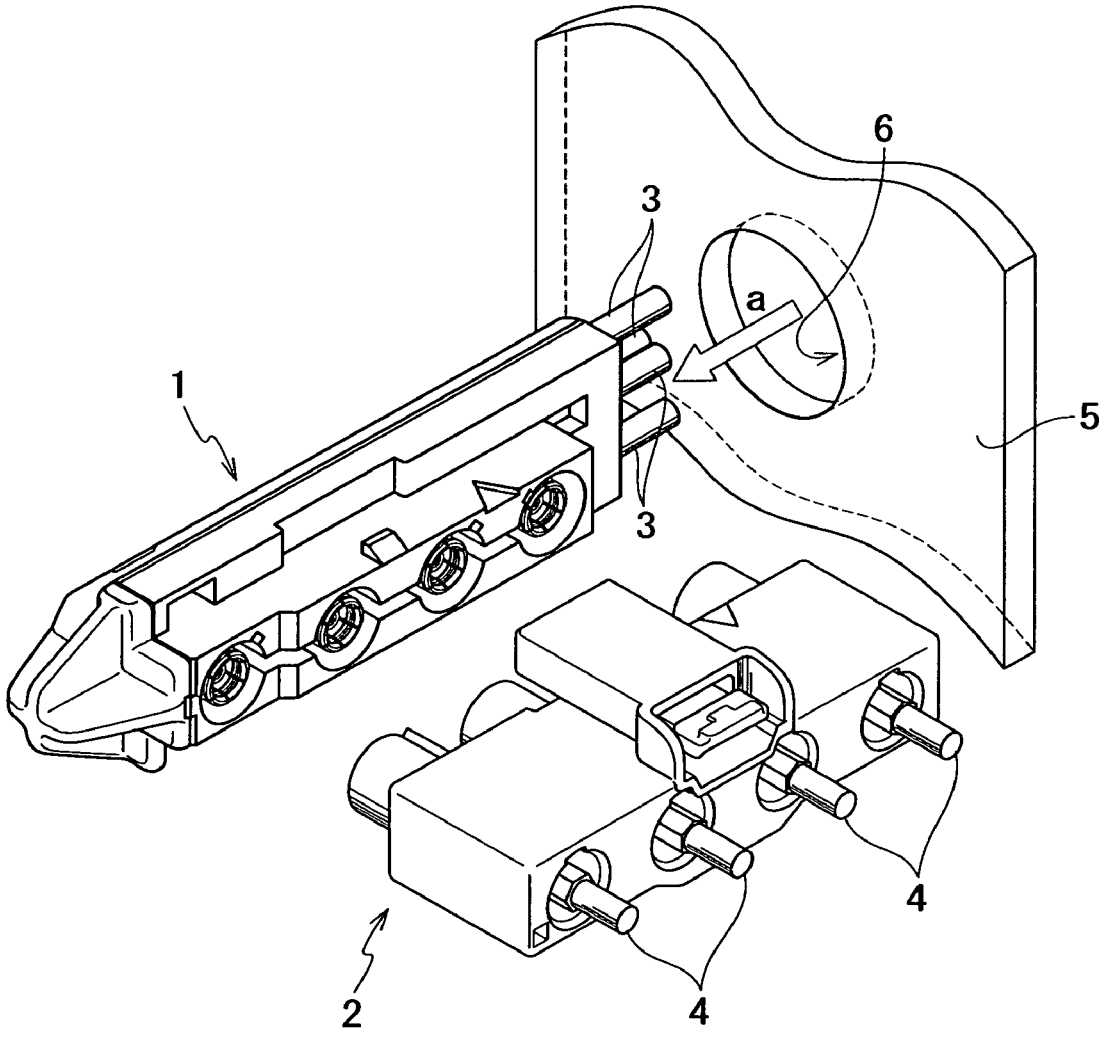
FIG. 1 is a perspective view of an electrical connecting device according to an embodiment of the present invention and a to-be-connected housing element that is connected to the electrical connecting device.

FIG. 1 is a perspective view showing a to-be-connected housing element 2 to which coaxial electric wires 4 (hereinafter, referred to simply as "electric wire(s) 4") of four poles (four pieces) are connected and an electrical connecting device 1 according to an embodiment of the present invention that is connected to coaxial electric wires 3 (hereinafter, referred to simply as "electric wire(s) 3") 3 of four poles (four pieces) that is connected to the to-be-connected housing element 2. For example, the electrical connecting device 1 and the to-be-connected housing element 2 are used as relay connectors for use in various multi-receivable antennas, such as an AM/FM antenna, a Cellular antenna, a GPS (Global Positioning System) antenna, a SDARS (Satellite Digital Audio Radio System) antenna, an ETC antenna, or a VICS antenna, that are attached to a vehicle.

Figure 2:
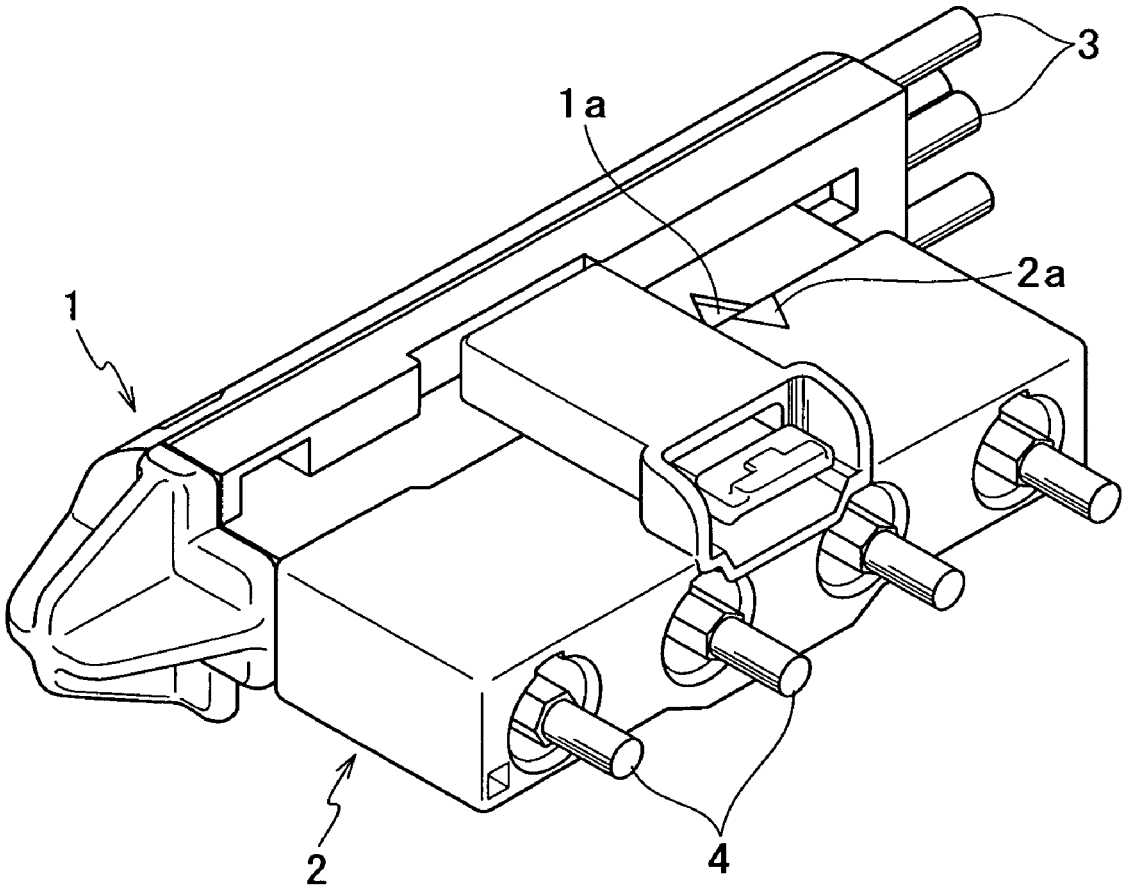
FIG. 2 is a perspective view showing a state in which the electrical connecting device and the to-be-connected housing element shown in FIG. 1 are connected.

The electrical connecting device 1 is inserted into a through-hole 6 formed in a vehicle roof 5, a part of which is shown in FIG. 1, in the direction of arrow "a," and is then connected to the to-be-connected housing element 2. As a result, the electric wire 3 and the electric wire 4 are passed through the through-hole 6 between the inside and the outside of the vehicle, and are electrically connected by means of the connectors (1 and 2). The electrical connecting device 1 and the to-be-connected housing element 2 are connected as shown in the perspective view of FIG. 2. A triangular mark 1*a* is impressed on the electrical connecting device 1 side, and, likewise, a triangular mark 2*a* is impressed on the to-be-connected housing element 2 side. These marks 1*a* and 2*a* are provided so that their positions coincide with each other when the electrical connecting device 1 and the to-be-connected housing element 2 are properly connected. A confirmation of a proper connection therebetween can be obtained by whether the electrical connecting device 1 and the to-be-connected housing element 2 are connected in a state in which the positions of the marks 1*a* and 2*a* coincide with each other.

Figure 3:
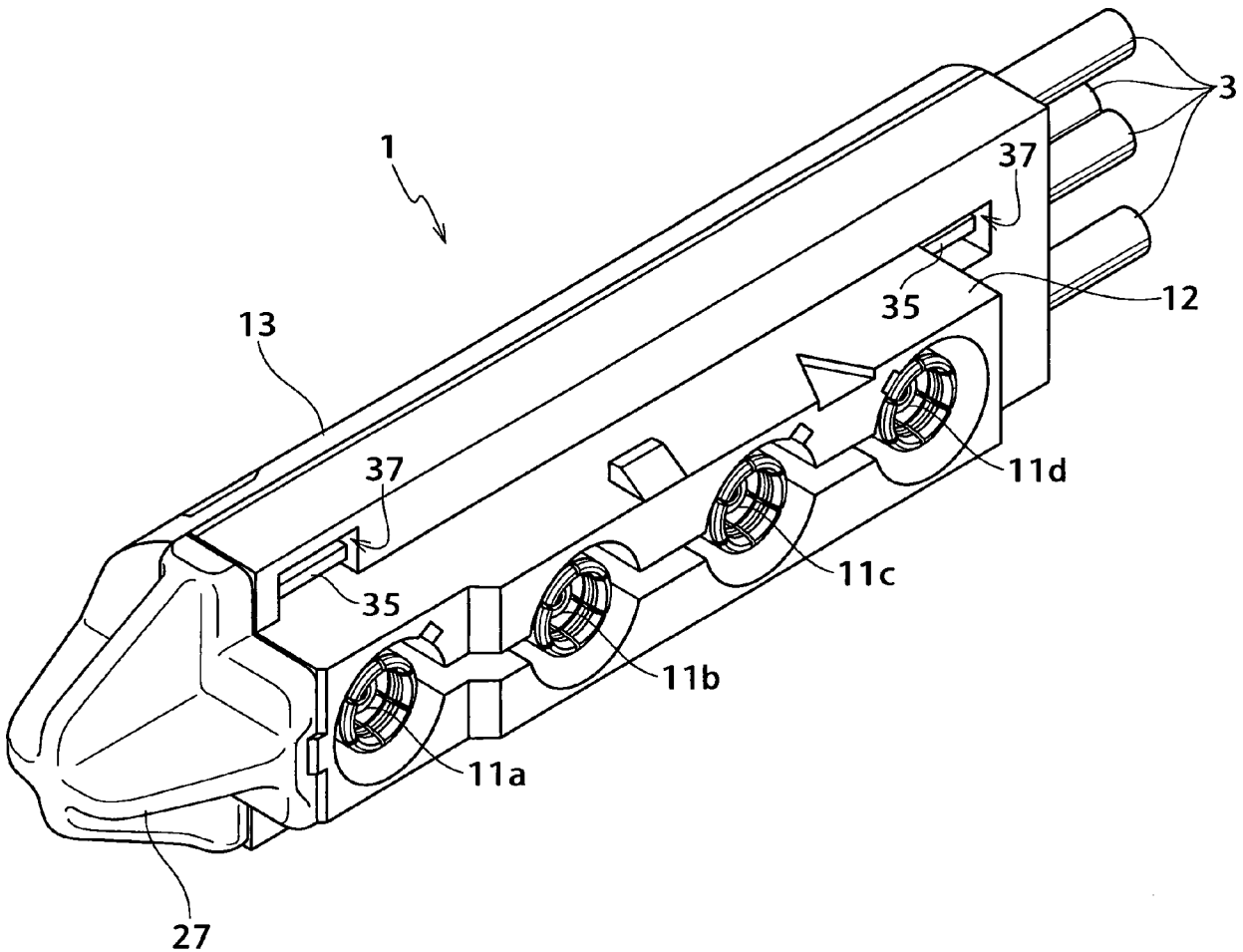
FIG. 3 is a perspective view of the electrical connecting device shown in FIG. 1.
Figure 4D:
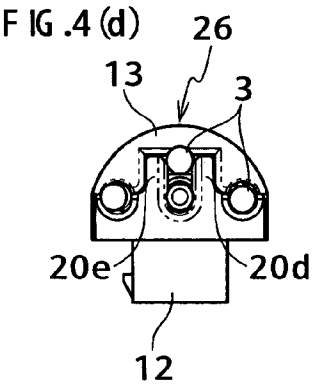
FIGS. 4(*a*), 4(*b*), 4(*c*), and 4(*d*) are a front view, a bottom view, a left side view, and a right side view of the electrical connecting device shown in FIG. 3, respectively.
Figure 4A:
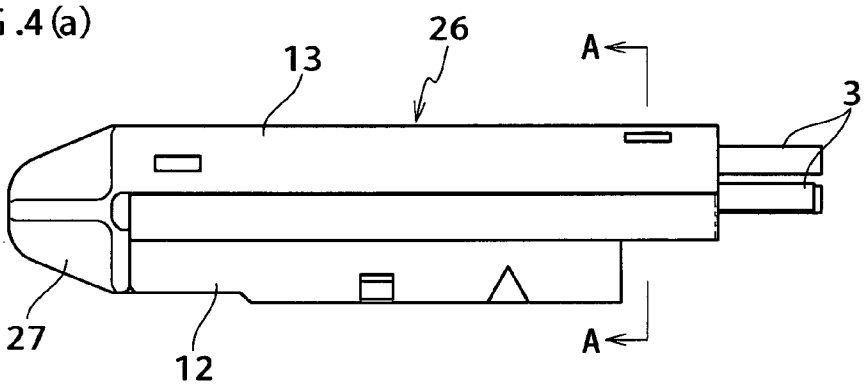
Figure 4B:
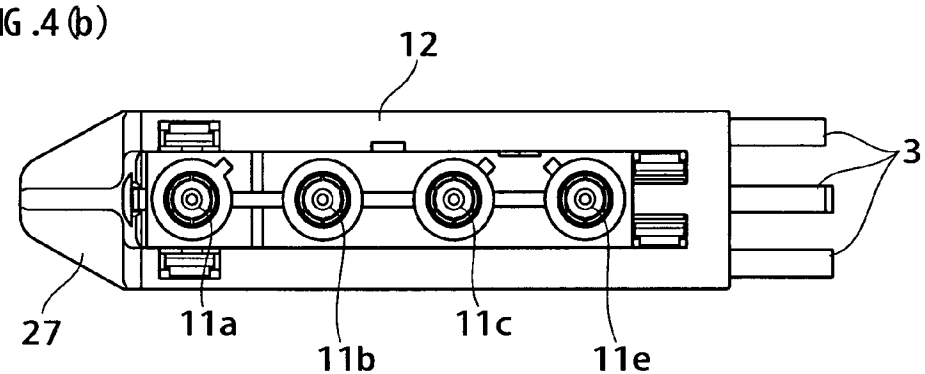
Figure 4C:
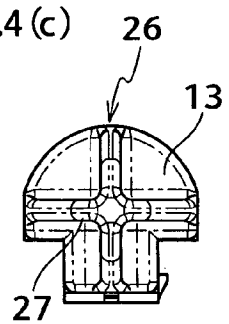
Figure 5:
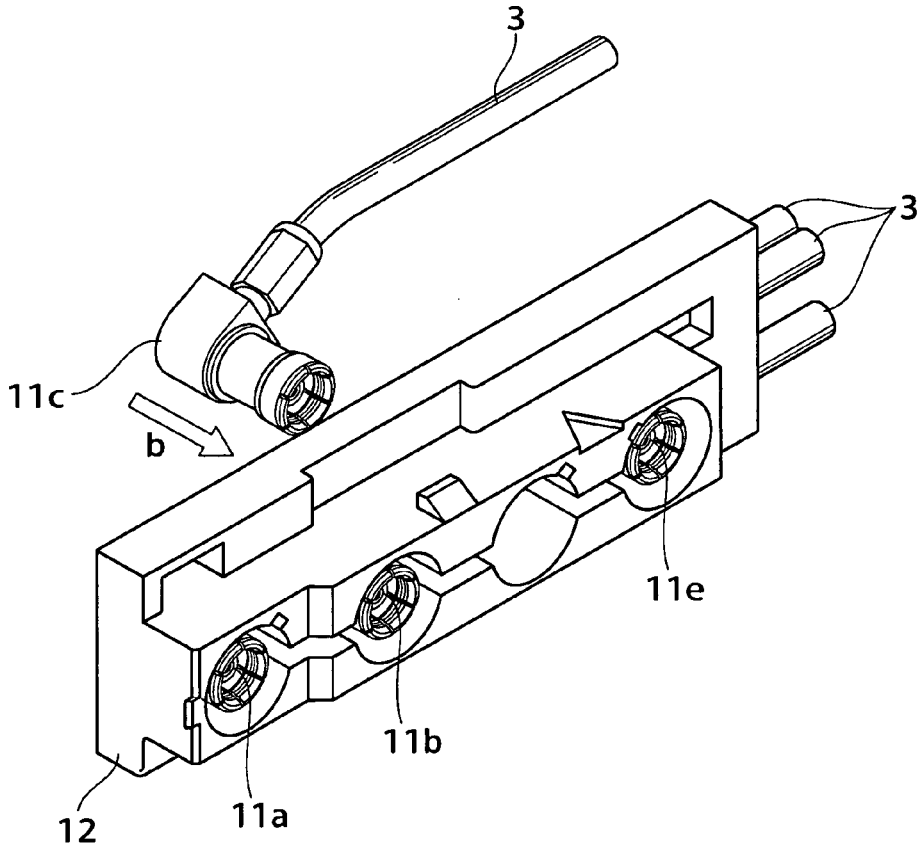
FIG. 5 is an exploded perspective view of a part of the electrical connecting device shown in FIG. 3.

FIG. 3 is a perspective view of the electrical connecting device 1. FIG. 4(*a*) to FIG. 4(*d*) are a front view (FIG. 4(*a*)), a bottom view (FIG. 4(*b*)), a left side view (FIG. 4(*c*)), and a right side view of the electrical connecting device 1, respectively. FIG. 5 is an exploded perspective view of a part of the electrical connecting device 1. As shown in FIG. 3 to FIG. 5, the electrical connecting device 1 includes connection terminals 11(11*a*–11*d*) of four poles (four pieces) that are connected to the ends of four electric wires 3, respectively, a connecting housing element 12 that is engaged with and is connected to the to-be-connected housing element 2, and a cover element 13 that is attached to the connecting housing element 12. The connection terminals 11 connected to the electric wires 3 are fitted in the direction of arrow "b" as shown in FIG. 5, and are supported by the connecting housing element 12. The cover element 13 is then fitted to the connecting housing element 12 so as to cover the connection terminals 11 as shown in FIG. 3 and FIG. 4.

Figure 6:
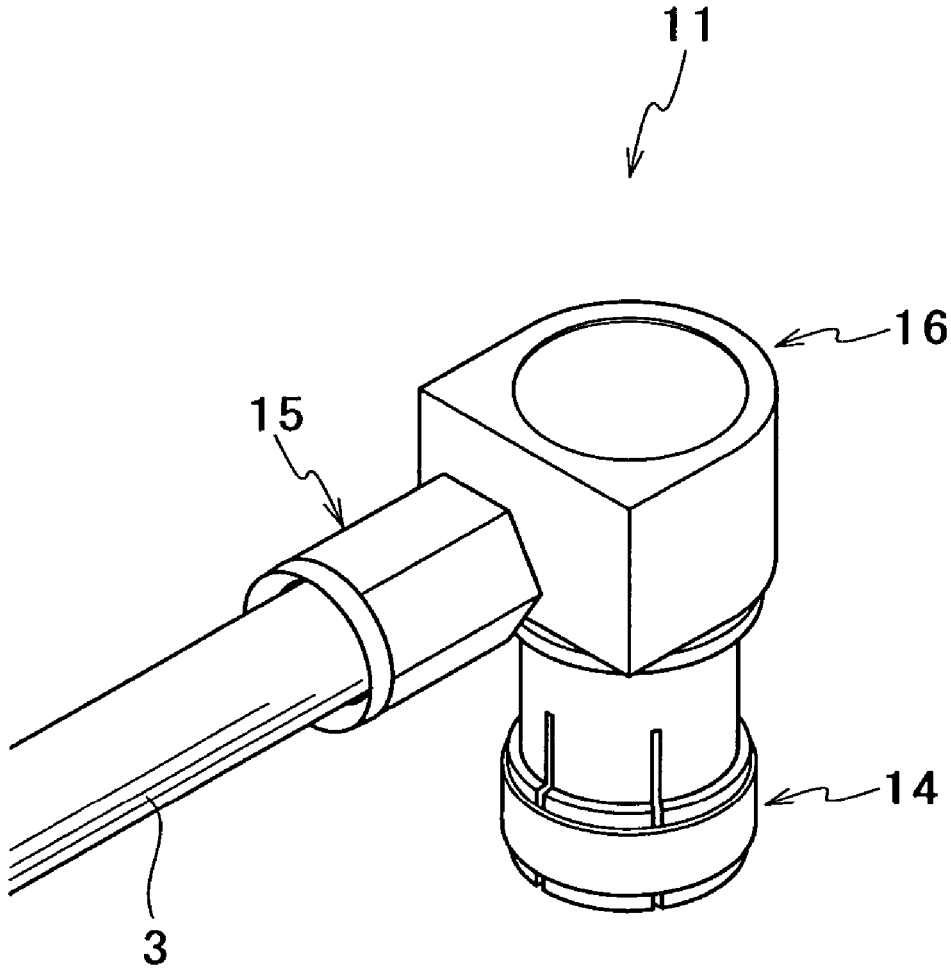
FIG. 6 is a perspective view of a connection terminal shown in FIG. 5.

In accordance with a connection between the electrical connecting device 1 and the to-be-connected housing element 2, the connection terminals 11 are electrically connected to to-be-connected terminals, respectively, of the to-be-connected housing element 2. As shown in the perspective view of FIG. 6, the connection terminal 11 has a terminal connection part 14, a wire connection part 15, and a bent part 16. The terminal connection part 14 is brought into contact with and connected to the to-be-connected terminal of the to-be-connected housing element 2. The wire connection part 15 is an end opposite the terminal connection part 14, and is connected to the electric wire 3 in a caulked manner. The bent part 16 is an intermediate part between the terminal connection part 14 and the wire connection part 15, and is bent rectangularly.

Figure 7:
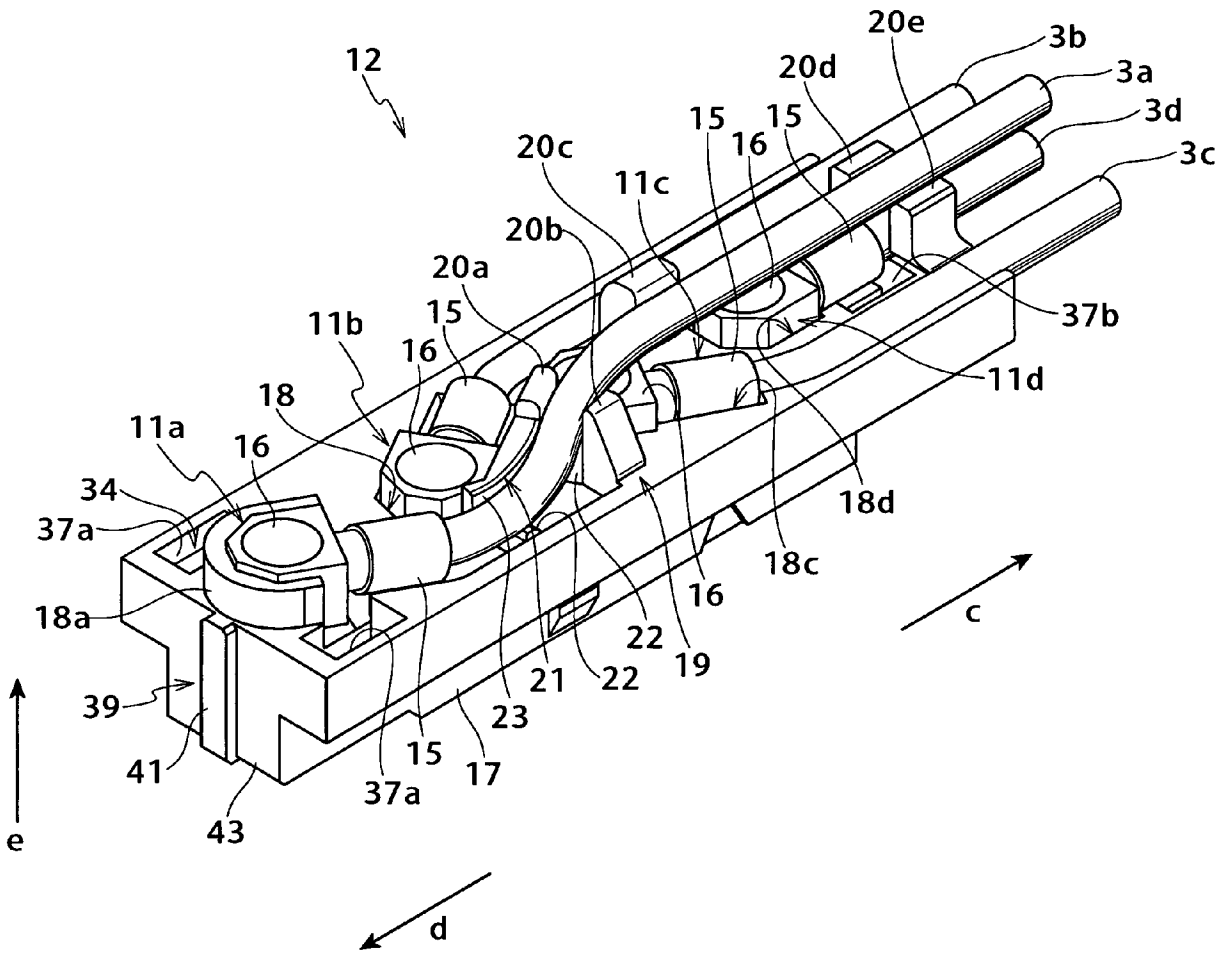
FIG. 7 is a perspective view of a connecting housing element shown in FIG. 3.

FIG. 7 is a perspective view of the connecting housing element 12, and shows a state in which the connection terminals 11(11*a*–11*d*) of four poles connected to the electric wires 3 (3*a*–3*d*) are attached to the connecting housing element 12. The connecting housing element 12 has a main body 17 shaped like a slender rectangular parallelepiped. Terminal supporting parts 18 and wire supporting parts 19 are formed on the main body 17.

As shown in FIG. 7, the terminal supporting parts 18 (18*a*–18*d*) are provided at four positions so as to support the connection terminals 11 of four poles, respectively. The connection terminal 11*a* is supported by the terminal supporting part 18*a*, the connection terminal 11*b* is supported by the terminal supporting part 18*b*, the connection terminal 11*c* is supported by the terminal supporting part 18*c*, and the connection terminal 1*d* is supported by the terminal supporting part 18*d*. The terminal supporting parts 18 are provided to support the connection terminals 11 so that the terminal connection parts 14 of the connection terminals 11 are arranged in rectilinear form. As shown in FIG. 3 and FIG. 4(*b*), the terminal connection parts 14 of the connection terminals 11 are supported in rectilinear form on the bottom side of the connecting housing element 12 (i.e., on the side where it is fitted with the to-be-connected housing element 2). Therefore, the connection terminals 11 can be connected to the to-be-connected terminals, 14 respectively, on the side of the to-be-connected housing element 2.

In FIG. 7, each terminal supporting part 18 is formed so that the connection terminal 11 can be held along the periphery of the lower half of the bent part 16. The connection terminal 1*d* is supported so that the direction in which the wire connection part 15 of the connection terminal 11*d* extends conforms to the direction in which the terminal connection parts 14 are arranged. In contrast, the connection terminals 11*a*–11*c* are supported so that the direction in which the wire connection parts 15 of the connection terminals 11*a*–11*c* extend deviates slantingly from the direction in which the terminal connection parts 14 are arranged. In other words, the front-side connection terminal 11 is supported so that the direction in which the wire connection part 15 of the front-side connection terminal 11 of the adjoining connection terminals 11 and 11, which is disposed on a front side (direction of arrow "d") opposite a rear side (direction of arrow "c") where the electric wire 3 is led out from the connecting housing element 12, deviates slantingly from the direction in which the terminal connection parts 14 are arranged.

The adjoining connection terminals 11 denote the connection terminals 11*a* and 11*b*, the connection terminals 11*b* and 11*c*, or the connection terminals 11*c* and 11*d*. For example, in a case in which the adjoining connection terminals are the connection terminals 11*a* and 11*b*, the front-side connection terminal 11 is the connection terminal 11*a*, and, in a case in which the adjoining connection terminals are the connection terminals 11*c* and 11*d*, the front-side connection terminal 11 is the connection terminal 11*c*. In this embodiment, one of the adjoining connection terminals 11 disposed on the rear side is referred to as a rear-side connection terminal in the same manner as one of the adjoining connection terminals 11 disposed on the front side is referred to as a front-side connection terminal 11. That is, in this embodiment, the connection terminals 11*a*, 11*b*, and 11*c* are corresponding to the front-side connection terminal 11, and the connection terminals 11*b*, 11*c*, and 11*d* are corresponding to the rear-side connection terminal 11.

Figure 8:
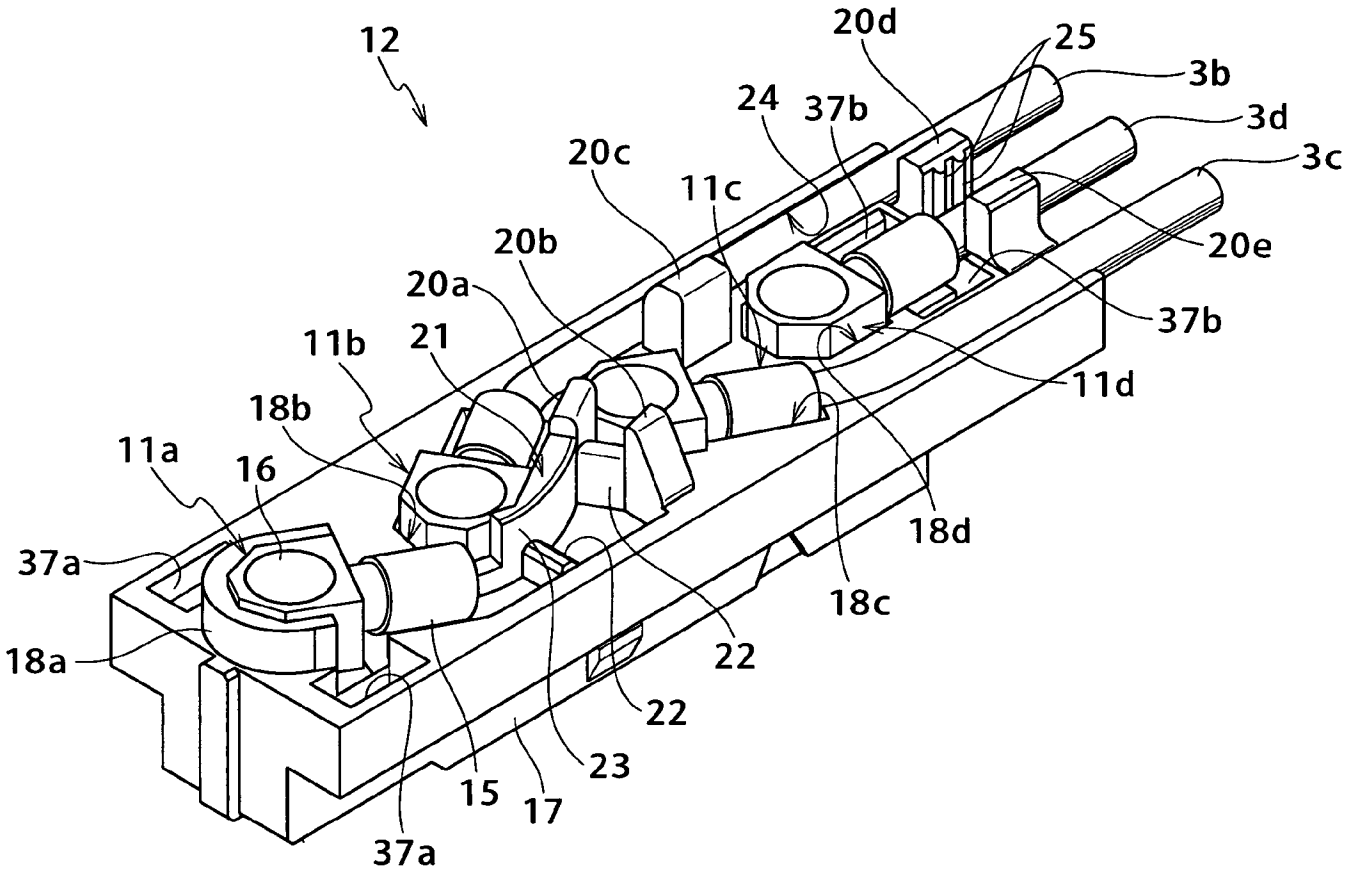
FIG. 8 is a perspective view of the connecting housing element shown in FIG. 3.

FIG. 8 is a perspective view of the connecting housing element 12 to which the connection terminals 11 (11*a*–11*d*) of four poles have been attached, showing a state in which only the electric wire 3*a* that is connected to the connection terminal 11*a* has been removed. As shown in FIG. 7 and FIG. 8, the wire supporting part 19 has a plurality of projection parts 20, a curved supporting part 21, and a fit supporting part 24. One of electric wires 3 is supported by the wire supporting parts 19 so that the one of electric wires 3 is led out in the direction in which the wire connection part 15 of each connection terminal 11 extends. The electric wire 3 that is connected to the front-side connection terminal 11 of the mutually adjoining connection terminals 11 is supported by the wire supporting part 19 so that the electric wire 3 is arranged in such a curved manner so as to detour around the periphery of the bent part 16 of the rear-side connection terminal 11 adjacent to the front-side connection terminal 11.

Figure 9:
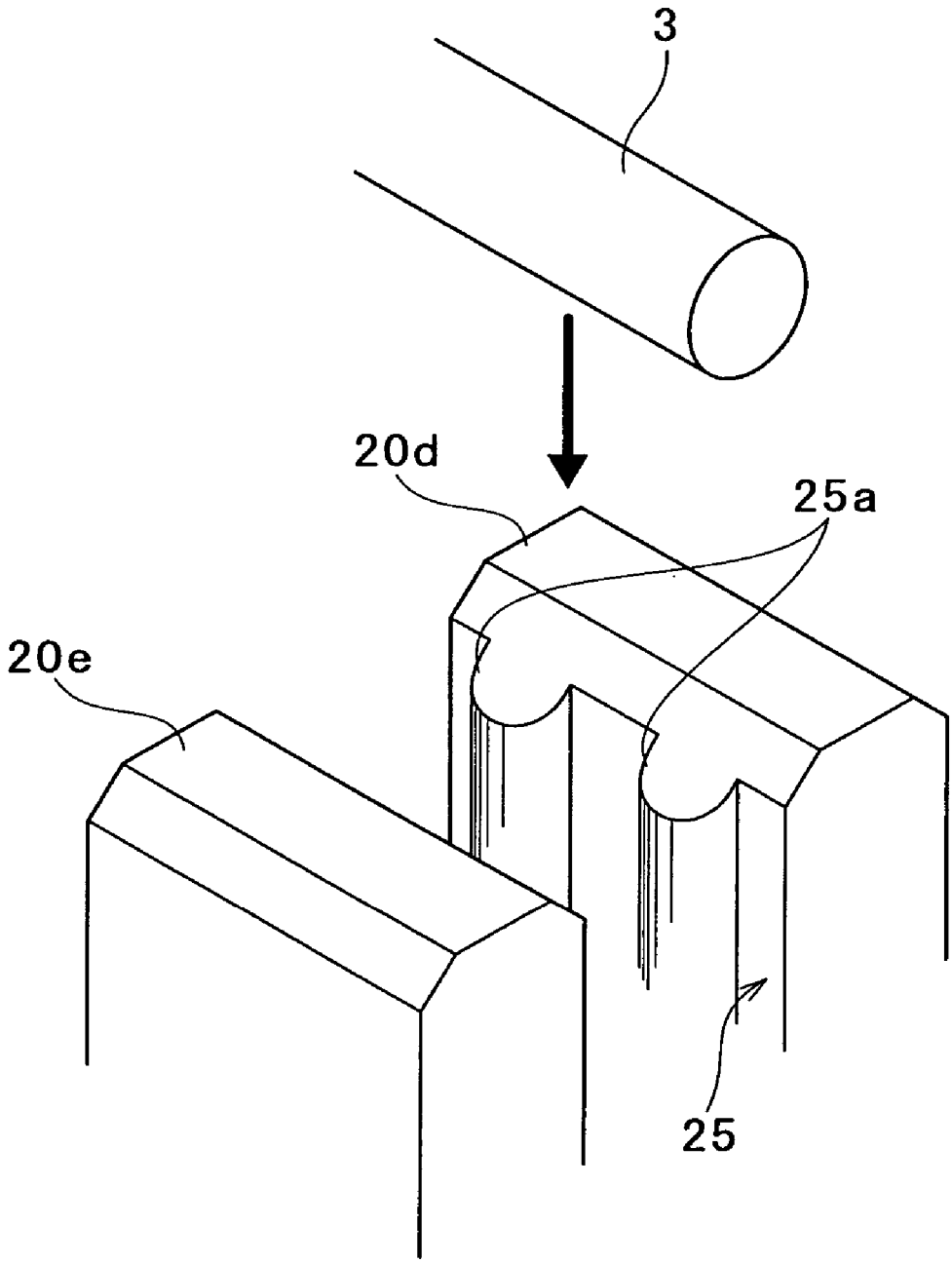
FIG. 9 is an enlarged perspective view of a projection part of the connecting housing element shown in FIG. 8.

As shown in FIG. 7, in the connecting housing element 12, the projection parts 20 (20*a* to 20*e*) protrude upward from a surface of the main body 17 (i.e., the direction of arrow "e" in FIG. 7) that is opposite the fit side on which the connecting housing element 12 is fitted to the to-be-connected housing element 2. The projection parts 20 are disposed so as to support the electric wire 3*a* connected to the foremost front-side connection terminal 11*a*. The electric wire 3*a* is supported by being fitted between a pair of projection parts that face each other in the projection parts 20 (i.e., between the projection parts 20*a* and 20*b*, and between the projection parts 20*d* and 20*e*). The pair of projection parts 20*d* and 20*e* that face each other supports the electric wire 3*a* connected to the connection terminal 11*a* and the electric wire 3*d* connected to the connection terminal 11*d* such that the electric wire 3*a* and the electric wire 3*d* are stacked on each other. That is, the pair of projection parts 20*d* and 20*e* serves as a stacking supporting part that supports the electric wires 3*a* and 3*d* so that respective cross-sections of parts of the electric wires 3*a* and 3*d* supported by the projection parts 20*d* and 20*e* are arranged in a stacked manner while being stepped. As shown in FIG. 8, on the mutually facing surfaces of the projection parts 20*d* and 20*e* in pairs, the projection parts 20*d* and 20*e* respectively have elongated ribs that protrude inwardly from the facing surfaces. FIG. 9 is an enlarged perspective view of the projection parts 20*d* and 20*e*. As shown in FIG. 9, the projection parts 20*d* and 20*e* have the mutually facing surfaces 25 (in FIG. 9, only the facing surface of the projection part 20*d* is shown), and each of the facing surfaces 25 has two elongated ribs 25*a*, each of which is formed in a semicircular shape in cross-section. The electric wires 3 are inserted toward the projection parts 20*d* and 20*e* (i.e., downward as shown by the arrow in FIG. 9), and are thereby fitted between the facing surfaces 25 and 25. The electric wires 3 fitted therebetween are supported while being clamped by the elongated ribs 25*a* between the facing surfaces 25 and 25 from both sides.

The curved supporting part 21 supports the electric wire 3*a* connected to the front-side connection terminal 11*a* such that the electric wire 3*a* is disposed in such a curved manner so as to detour the periphery of the bent part 16 of the rear-side connection terminal 11*b* while displacing its height in an insertion direction (i.e., the direction of arrow "e"). As shown in FIG. 8, the curved supporting part 21 includes a step part 22 and a curved wall surface 23. The step part 22 protrudes upwardly from the surface of the connecting housing element 2 so that the height thereof becomes greater step-by-step, and is formed like stairs having a plurality of steps. The curved wall surface 23 serves as a side surface of the curved supporting part 21, and the curved wall surface 23 is in contact with the electric wire 3*a*. In this electrical connecting device 1, the electric wire 3*a*, which is the upper one of the electric wires 3*a* and 3*d* stacked between the projection parts 20*d* and 20*e* serving as the stacking supporting part, is disposed in such a curved manner so as to detour the periphery of the bent part 16 of the rear-side connection terminal 11*b* while displacing its height in the insertion direction (see FIG. 7).

The fit supporting parts 24 are hollowed like a groove. As shown in FIG. 8, the electric wire 3*b*, which is connected to the connection terminal 11*b*, and the electric wire 3*c*, which is connected to the connection terminal 11*c*, are fitted into and supported by the fit supporting parts 24. The electric wires 3*b* and 3*c* are supported by the supporting parts 24 in such a way as to be led out in the direction of the terminal connection part 14, and are curved in such a way to detour the periphery of the bent part 16 of each of the rear-side connection terminals 11*c* and 11*d*.

As mentioned above, in the connecting housing element 12, the position of each electric wire 3 can be fixed by the wire supporting parts 19. Fluctuations in radio interference characteristics between the electric wires 3 (i.e., fluctuations in radio interference characteristics as a unit of the electrical connecting device 1 which is a product) can be controlled by fixing the position of the electric wire 3. Additionally, since the electric wires 3*a*–3*c* that are connected to the front-side connection terminals 11*a*–11*c* are arranged in such a curved manner so as to detour the peripheries of the leading-side connection terminals 11*b* to 11*d*, the electric wires 3*a* to 3*c* can be prevented from being bent. Especially, a coaxial electric wire for high frequencies easily causes performance degradation (VSWR) when bent, and hence the occurrence of such performance degradation can be prevented.

Figure 10:
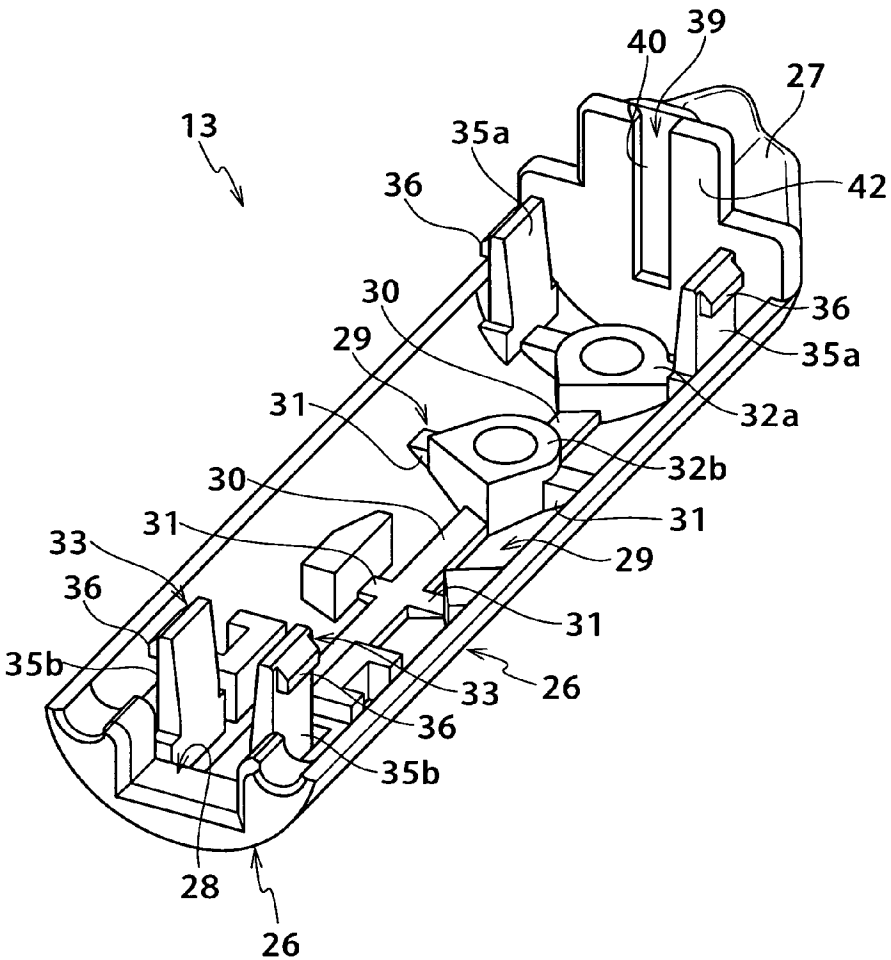
FIG. 10 is a perspective view of a cover element shown in FIG. 3.

FIG. 10 is a perspective view of the cover element 13, in which a side of the cover element 13 that is connected to the connecting housing element 12 is directed upward. The cover element 13 is attached to the connecting housing element 12 so as to cover the connection terminals 11 (see FIG. 3). As shown in FIG. 4 and FIG. 10, the cover element 13 has an arcuate dome part 26 in a cross-section perpendicular to the direction in which the electric wire 3 is disposed in a parallel manner by means of the wire supporting parts 19 of the connecting housing element 12. The electric wires 3 are arranged in a stacked manner in the connecting housing element 12, and are crowded inside the dome part 26 by attaching the cover element 13 to the connecting housing element 12.

As shown in FIG. 3, FIG. 4(*a*) to FIG. 4(*d*), and FIG. 10, the cover element 13 has a front part 27, which is formed in a tapered shape. The cover element 13 is formed so that a front part of the connecting housing element 12 to which the cover element 13 is attached is covered with the front part 27 of the cover element 13. Since the front part 27 is tapered toward its tip, the cover element 13 can be inserted into the through-hole 6 smoothly and easily. Additionally, the front part 27 is formed so that its cross-section perpendicular to the direction toward its tip exhibits either a point symmetry and a linear symmetry shape. More specifically, the cross-section of the extreme part 27 is shaped like a cross. Since the cross-section of the extreme part 27 is formed to exhibit at least either a point symmetry shape or linear symmetry shape, the tapered front part 27 can have sufficient strength against an impact acting in a bent direction, and, the front part 27 can be prevented from being damaged even if the front part 27 is impacted by coming into collision with the edge of the roof through-hole 6 when the front part 27 is inserted into the through-hole 6.

The cover element 13 has a difference in shape between one end of the cover element 13 on the rear side where the electric wire 3 is led out and the opposite end. Therefore, the direction in which the cover element 13 is attached to the connecting housing element 12 can be restricted to a single direction. As a result, erroneous connecting operations can be prevented when the electrical connecting device 1 is assembled. An opening part 28 that is engaged with the pair of projection parts 20*d* and 20*e* of the connecting housing element 12 is formed at the end on the rear side of the cover element 13 (see FIG. 4(*d*) and FIG. 10).

As shown in FIG. 10, the cover element 13 has a reinforcement part 29 formed by partially thickening the dome part 26. The reinforcement part 29 includes a first reinforcement part 30 and a second reinforcement part 31. The first reinforcement part 30 is formed on an inner surface of the dome part 26, and serves as a rib that protrudes from the inner surface. The first reinforcement part 30 is linearly formed in the direction in which the terminal connection part 14 is arranged in the connecting housing element 12 to which the cover element 13 is attached. That is, the rib forming the first reinforcement part 30 is linearly extended in the longitudinal direction of the cover element 13.

The second reinforcement part 31 is also formed on the inner surface of the dome part 26, and serves as a rib that protrudes from the inner surface in the same manner as the first reinforcement part 30. The second reinforcement part 31 is formed so as to be disposed along a cross-section of the dome part 26 perpendicular to the direction in which the terminal connection part 14*s* are arranged in the connecting housing element 12 (i.e., along a cross-section perpendicular to the longitudinal direction of the cover element 13). The second reinforcement part 31 is intersected with the first reinforcement part 30, and is formed integrally with the first reinforcement part 30 at the intersection of the first and second reinforcement parts 30 and 31. Thus, the reinforcement part 29 is disposed so as to function as a framework by which the shape of the cover element 13 is easily maintained.

The cover element 13 additionally has regulating parts 32 (32*a* and 32*b*) that regulate the movement of the connection terminals 11 between the cover element 13 and the connecting housing element 12 when the cover element 13 is attached to the connecting housing element 12. The regulating parts 32 protrude from the dome part 26 at a plurality of positions, respectively. The regulating part 32*a* regulates the movement of the connection terminal 11*a* by interference with the connection terminal 11*a*, and the regulating part 32*b* regulates the movement of the connection terminal 11*b* by interference with the connection terminal 11*b*. The regulating parts 32 (32*a* and 32*b*) are formed integrally with the dome part 26 and are united with each other with the reinforcement part 29 (the first reinforcement part 30) therebetween. By way of this configuration, the position of the connection terminal 11 can be fixed in the fitting direction when the cover element 13 is attached, and the connection terminal 11 can be prevented from being supported in an improper state (i.e., in a state of being incompletely inserted).

Thus, in the cover element 13, a space inside the dome part 26 can be effectively utilized. Further, the dome part 26 can be provided with the partially thickened reinforcement part 29 at a space where interference of the connection terminals 11 with the electric wires 3 does not occur. Therefore, the strength of the dome part 26 can be increased without obstruction to the size reduction of the cover element 13. Additionally, since the cover element 13 has the first reinforcement part 30, linearly formed in the longitudinal direction of the cover element 13, the bending strength with respect to the longitudinal direction of the cover element 13 can be increased. Additionally, since the cover element 13 has the second reinforcement part 31, disposed along the cross-section of the dome part 26 perpendicular to the longitudinal direction of the cover element 13, the torsional strength with respect to the longitudinal direction of the cover element 13 can be increased. Additionally, since the cover element 13 has the regulating parts 32 united with each other with the reinforcement part 29 (first reinforcement part 30) therebetween, the regulating parts 32 can be effectively utilized as a part of the reinforcement part 30.

As shown in FIG. 10, a cover-side engagement part 33 is provided on the inner surface of the cover element 13. On the other hand, as shown in FIG. 7, a housing-side engagement part 34 is provided on the surface of the connecting housing element 12 that is opposite to the inner surface. The cover-side engagement part 33 and the housing-side engagement part 34 are formed so as to be engaged with each other, and hence a locking mechanism is formed when the cover element 13 is attached to the connecting housing element 12.

As shown in FIG. 10, the cover-side engagement part 33 has leg parts 35 (35*a* and 35*b*) and latching parts 36. The leg part 35 protrudes toward the connecting housing element 12. A pair of leg parts 35*a* and 35*a* are provided on the front side of the cover element 13, and a pair of leg parts 35*b* and 35*b* are provided on the rear side of the cover element 13. At the tip of each leg part 35, the latching part 36 further protrudes from each leg part 35 outward (i.e., from a side opposite the side where the pair of leg parts 35*a* and 35*a* or 35*b* and 35*b* face each other).

The housing-side engagement part 34 has hole parts 37 (37*a* and 37*b*) and engagement concave parts 38. As shown in FIG. 7 and FIG. 8, the hole part 37 is formed of a pair of hole parts 37*a* and 37*a* provided on the front side and a pair of hole parts 37*b* and 37*b* provided on the rear side. Each hole part 37 serves as a through-hole into which each leg part 35 of the cover element 13 is fitted. The pair of leg parts 35*a* and 35*a* are fitted into the pair of hole parts 37*a* and 37*a*, respectively, whereas the pair of leg parts 35*b* and 35*b* are fitted into the pair of hole parts 37*b* and 37*b*, respectively.

Figure 11:
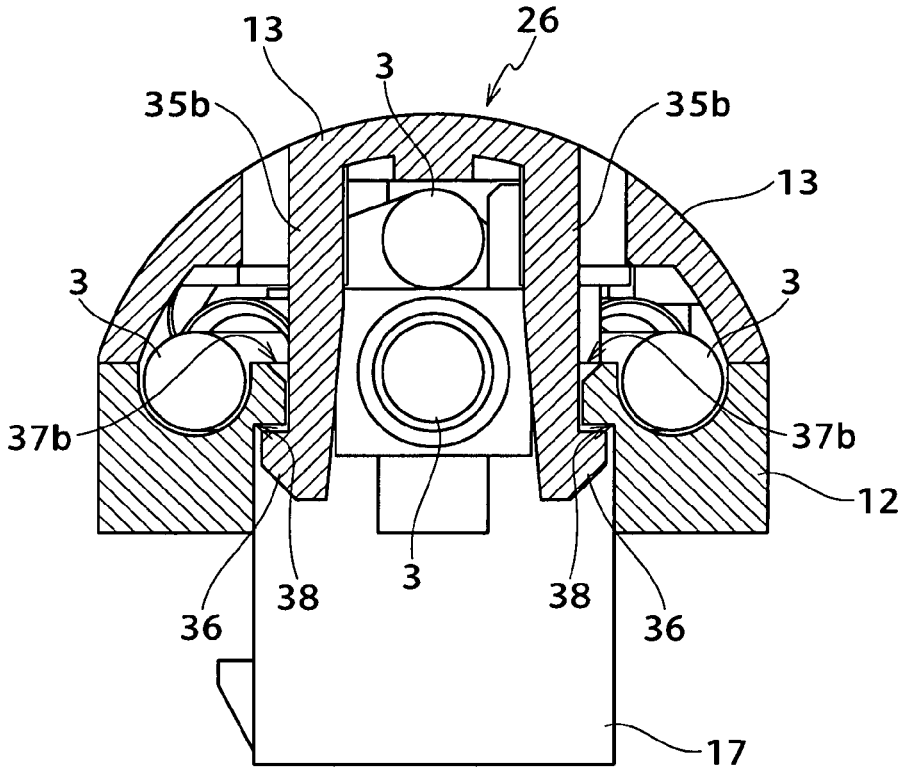
FIG. 11 is a cross-sectional view along line A—A of FIG. 4.

The engagement concave part 38 has a hollow corresponding to each hole part 37. FIG. 1 is a cross-sectional view along line A—A of FIG. 4 (in which the cross-section of the electric wire 3 is not shown). As shown in FIG. 11, each engagement concave part 38 is hollowed so as to be engaged with each latching part 36 in a state in which the leg part 35 is fitted to the hole part 37. When the cover element 13 is attached to the connecting housing element 12, and then the leg part 35 is fitted into the hole part 37, the latching part 36 at the top of the leg part 35 first interferes with the edge of the hole part 37. The latching part 36 proceeds into the hole part 37 while the leg part 35 is being bent toward the inside by this interference. When the latching part 36 reaches the position facing the engagement concave part 38, the latching part 36 and the engagement concave part 38 are engaged with each other, and the cover element 13 is reliably held (locked) in the connecting housing element 12.

As shown in FIG. 3, the leg part 35 of the cover element 13 has a length not to protrude from the hole part 37 of the connecting housing element 12. The leg part 35 protrudes within the dimensions of the dome part 13, and thus it neither appears from the side face of the connecting housing element 12 nor protrudes from the hole part 37 when the cover element 13 is attached to the connecting housing element 12. Therefore, when the cover element 13 is attached to the connecting housing element 12, the leg part 35 can be prevented from interfering with an external member and being damaged. For example, when the electrical connecting device 1 is inserted into the through-hole 6, the leg part 35 can be prevented from interfering with the edge of the through-hole 6 and being damaged.

As shown in FIG. 7 and FIG. 10, each of the cover element 13 and the connecting housing element 12 has a positioning part 39 on the front side by which the cover element 13 and the connecting housing element 12 are engaged and positioned. The positioning part 39 is formed of a groove (first groove) 40 formed on the cover element 13 and an elongated protrusion (second elongated rib) 41 that is formed on the connecting housing element 12 and that is engaged with the groove 40. The groove 40 of the cover element 13 is formed on the reverse surface of a wall provided to support the front part 27, i.e., on a first sliding surface 42 that is slid and put onto the end of the front part 27. The groove 40 is linearly hollowed. On the other hand, the elongated protrusion 41 on the side of the connecting housing element 12 is formed on an end surface on the front side, i.e., on a second sliding surface 43 that is slid onto the first sliding surface 42 of the cover element 13 on the front side of the connecting housing element 12. The elongated protrusion 41 is linearly ridged so as to be engaged with the groove 40.

By way of this configuration, the cover element 13 can be attached to the connecting housing element 12 so that the groove 40 and the elongated protrusion 41 are engaged with each other while being slid onto each other. Therefore, the front side of the cover element 13 can be easily subjected to proper positioning with respect to the connecting housing element 12 when the cover element 13 is attached to the connecting housing element 12. Additionally, the cover element 13 can be prevented from being improperly attached to the connecting housing element 12 while being deviated in the width direction. Additionally, since the cover element 13 is attached to the connecting housing element 12 while the groove 40 and the elongated protrusion 41, which are linearly formed with a long length, are being fitted to each other, the cover element 13 can be prevented from being rotated in the torsional direction with respect to the longitudinal direction during the attaching operation, and can be prevented from being damaged by rotational movement.

According to the electrical connecting device 1 as described above, the connection terminal 11 has the bent part 16 formed between the terminal connection part 14 and the wire connection part 15, and the electric wire 3 connected to the wire connection part 15 is led out in the longitudinal direction of the connecting housing element 12. Additionally, the electric wire 3 connected to the front-side connection terminal 11 is disposed in such a curved manner so as to detour the periphery of the bent part 16 of the rear-side connection terminal 11. Therefore, the electric wires 3 can be bundled in the longitudinal direction, and can be effectively crowded without interference with the rear-side connection terminal 11, thus making it possible to integrate a space to dispose the electric wires 3. In other words, it is possible to efficiently prevent the fact that the electrical connecting device becomes large depending on the pitch where the terminal connection parts 14 are arranged in parallel, and, accordingly, the electrical connecting device can be reduced in size.

This is advantageous in assembling work within a limited space like a narrow space. Since the electrical connecting device 1 is slender in the longitudinal direction in which the terminal connection parts 14 are arranged, a great advantage can be obtained especially when a through-hole in the wall surface is connected to another member after the electrical connecting device 1 is passed therethrough. In other words, the dimensions of the through-hole can be reduced, and the electrical connecting device 1 can be easily passed therethrough.

Figure 12:
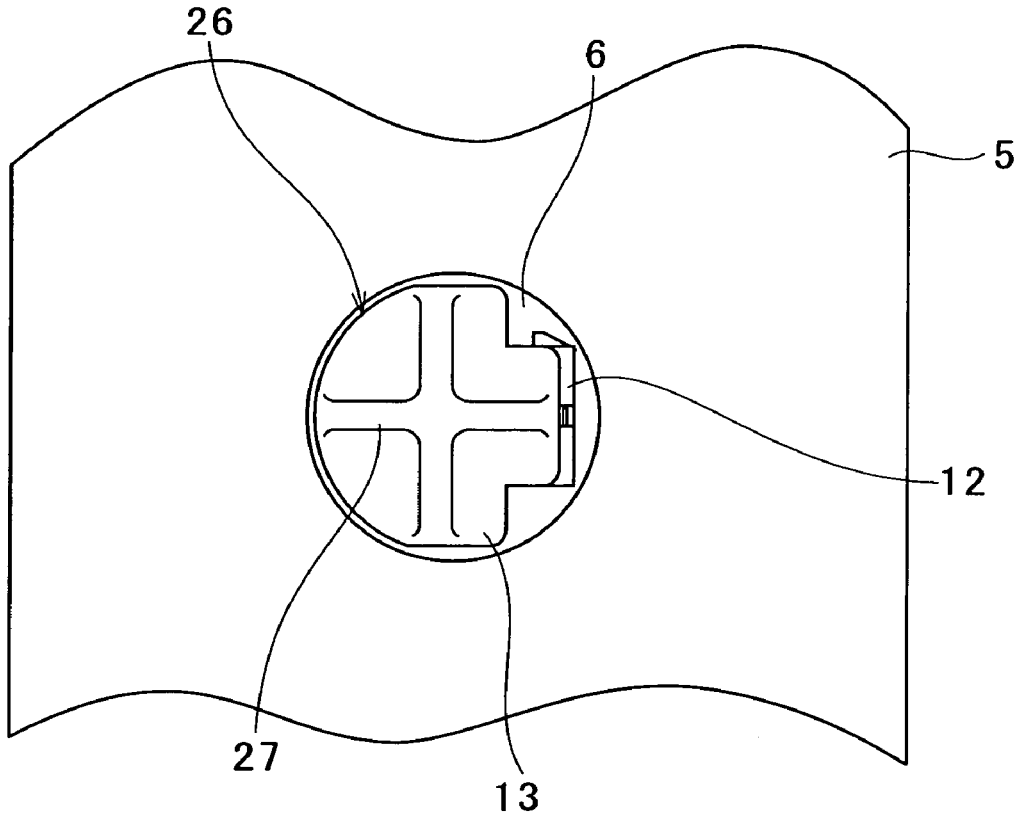
FIG. 12 shows a state in which an assembled electrical connecting device is inserted in a through-hole disposed on a roof of the vehicle.

FIG. 12 shows the electrical connecting device 1 viewed from its front side in a state in which the electrical connecting device 1 already assembled is inserted in the through-hole 6. Since the electrical connecting device 1 can be made slender and compact and since a cross-sectional area of the electrical connecting device 1 can be reduced in a direction in which the electrical connecting device 1 is passed through the through-hole 6, the electrical connecting device 1 can be smoothly passed through the through-hole 6 small in the opening area as shown in FIG. 12. Additionally, since the cover element 13 has the dome part 26, a part of the outer periphery of the electrical connecting device 1 can be contoured with the inner periphery of the circular through-hole 6, and the electrical connecting device 1 never interferes with the edge of the through-hole 6. Therefore, the electrical connecting device can be reduced in size.

Additionally, according to the electrical connecting device 1, the electric wires 3 can be efficiently gathered together without interference between the electric wires 3 connected to the front-side connection terminals 11 and the rear-side connection terminals 11. Therefore, it is possible to ease dimensional restrictions on the arrangement of the front-side connection terminals 11 and the rear-side connection terminals 11 that adjoin each other. That is, since an interval between the front-side connection terminal 11 and the rear-side connection terminal 11 can be shortened, a size reduction in the longitudinal direction can be achieved. Further, the design freedom of the wire connection part 15 of the front-side connection terminal 11 can be increased. Furthermore, it is possible to prevent the electric wire 3 connected to the wire connection part 15 of the front-side connection terminal 11 from excessively being bent.

Therefore, it is possible to reduce a disadvantage resulting from dimensional restrictions on a connection between the to-be-connected housing element that supports the to-be-connected terminals of four or more poles arranged in rectilinear form and the electrical connecting device that has the connecting housing element supporting the connection terminals of four or more poles that are electrically connected to the to-be-connected terminals, respectively. Therefore, the electrical connecting device can be reduced in size.

Additionally, since the bent part 16 is bent at a right angle in the electrical connecting device 1, it is possible to diminish the distance between the straight line along which the terminal connection parts 14 are arranged in parallel and the electric wire 3 that is connected to the wire connection part 15 and that is arranged in parallel with the straight line. That is, a slender shape extending in the direction in which the terminal connection part 14 is arranged can be formed, and the electrical connecting device can be made more compact.

Additionally, since the direction of the wire connection part 15 is deviated obliquely with respect to the longitudinal direction of the electrical connecting device 1, a space in the width direction can be effectively utilized in the electrical connecting device 1, and the electric wires 3 can be more efficiently gathered without interference between the electric wires 3 connected to the front-side connection terminals 11 and the rear-side connection terminals 11.

Additionally, in the electrical connecting device 1, the electric wires 3 connected to the front-side connection terminals 11 are disposed in such a curved manner so as to detour the periphery of the rear-side connection terminal 11 at different heights off the surface of the connecting element. Therefore, interference can be avoided between the electric wires 3 connected to the front-side connection terminals 11 and the rear-side connection terminals 11, and the electric wires 3 can be efficiently gathered even in a space on the surface of the connecting housing element 12. Therefore, it is possible to achieve a greater reduction of dimensional restrictions on the arrangement of the front-side connection terminal 11 and the rear-side connection terminal 11 that adjoin each other.

Additionally, since the electric wires 3 that are connected to the wire connection parts 15 and that are arranged in the longitudinal direction can be disposed so as to be stacked in the electrical connecting device 1, the electric wires 3 can be more densely bundled in the longitudinal direction. Since the upper one of the electric wires 3 stacked thereon is disposed in such a curved manner so as to detour the periphery of the rear-side connection terminal 11 at different heights off the surface of the connecting housing element, the electric wires 3 can be efficiently gathered without interference between the electric wires 3 connected to the front-side connection terminals 11 and the rear-side connection terminals 11 when the upper electric wire 3 is disposed in such a curved manner.

Additionally, the curved supporting part 21 is formed as the wire supporting part 19 in the electrical connecting device 1, and therefore, when the electric wire 3 connected to the front-side connection terminal 11 is disposed in such a curved manner so as to detour the periphery of the leading-side connection terminal 11 at different heights off the surface of the connecting element housing, the electric wire 3 connected to the front-side connection terminal 11 can be stably supported without movement.

Additionally, since a step part 22 having a plurality of steps that become higher step by step is provided as the curved supporting part 21 in the electrical connecting device 1, the electric wire 3 can be disposed, smoothly rising upward. Additionally, the curved supporting part 21 can be easily formed by a simple structure that the step part 22 having a plurality of steps is provided.

Additionally, since the curved wall surface 23 is formed as the curved supporting part 21 in the electrical connecting device 1, the electric wire 3 connected to the front-side connection terminal 11 along the curved wall surface 23 is disposed so as to smoothly detour the periphery of the leading-side connection terminal 11 at different heights off the surface of the connecting housing element. Additionally, the curved electric wire 3 can be stably supported.

Additionally, in the electrical connecting device 1, the electric wires 3 can be supported merely by providing a plurality of projection parts 20 on the connecting housing element 12 and by fitting the electric wires 3 between the pair of projection parts 20 that face each other. Therefore, the wire supporting part 19 can be easily formed. Additionally, since the elongated ribs 25*a* are formed on each facing surface 25 of the projection parts 20, the electric wire 3 fitted between the projection parts 20 can be stably supported by the elongated ribs 25*a*. Additionally, since the elongated rib 25*a* is formed in a semicircular shape in cross-section, the electric wires 3 can be tangentially supported by the parts between the elongated ribs 25*a*, and the electric wires 3 can be held with a greater force. Additionally, since the elongated rib 25*a* is formed in a semicircular shape in cross-section, the electric wires 3 can be prevented from being flawed by the elongated rib 25*a*.

Additionally, in the electrical connecting device 1, the cover-side engagement part 33 is provided inside the cover element 13, and the housing-side engagement part 34 is provided on the surface of the connecting housing element 12. Therefore, when the cover-side engagement part 33 and the housing-side engagement part 34 are engaged with each other, and then the cover element 13 is attached to the connecting housing element 12, neither the cover-side engagement part 33 nor the housing-side engagement part 34 can be exposed outward. Therefore, an engagement mechanism between the cover element 13 and the connecting housing element 12 can be prevented from interfering with an external member and from being damaged. Additionally, the leg part 35 having the latching part 36 is provided inside the cover element 13 and the hole part 37 having the engagement concave part 38 provided on the connecting housing element 12. It is possible to easily form the engagement mechanism between the cover element 13 and the connecting housing element 12, resulting in a simple structure without being exposed outward.

Additionally, in the electrical connecting device 1, in order to attach the cover element 13 to the connecting housing element 12, the positioning part 39 formed on the front side is first engaged, whereby the cover element 13 and the connecting housing element 12 can be easily positioned. Therefore, the cover element 13 can be promptly attached without a positional disagreement between the connecting housing element 12 and the cover element 13. Additionally, since this positioning can be performed at once when the cover element 13 is attached to the connecting housing element 12, the cover element 13 can be prevented from being improperly attached to the connecting housing element 12 by mistake. Additionally, the occurrence of damage or the like resulting from the incorrect attachment in a deviated position can be prevented. Additionally, since the positioning part 39 is formed of the groove 40 and the elongated protrusion 41 that are engaged with each other, the positioning of the cover element 13 and the connecting housing element 12 by using the positioning part 39 makes it possible to prevent the cover element 13 from being attached in a state of being twisted with respect to the connecting housing element 12.

The embodiment of the present invention has been described as above. However, as a matter of course, the present invention is intended to embrace all modifications, variations, and their equivalents that fall within the spirit and scope of the appended claims, and such modifications and variations will become apparent by reading and understanding this specification.

For example, the following modifications may be carried out.

In the above embodiment, a description was given of the electrical connecting device that is first inserted into the through-hole provided on a roof, and is then connected to the to-be-connected housing element. However, the present invention can also be applied to a hole formed at a place other than the roof. Likewise, the present invention can be applied in a case in which the electrical connecting device is inserted into a hole other than that of a vehicle. Additionally, without being limited to a case in which the electrical connecting device is inserted into such a hole, the present invention can be applied in a case in which connecting operations are performed in a limited space like a narrow space.

In the above embodiment, a description was given of the electrical connecting device used for coaxial electric wires. However, the present invention can be applied to electric wires that are not coaxial.

In the above embodiment, a description was given of a case in which the bent part of the connection terminal is formed at a right angle. However, the present invention is not limited to such a rectangularly bent part. For example, the bent part may be formed to be a two-stage bent part having each stage bent at an angle of about 45 degrees.

The shape of the wire supporting part and the shape of the terminal supporting part provided on the connecting housing element are not limited to those of the above embodiment. That is, the shape of the terminal supporting part is not limited to the aforementioned one as long as the terminal connection parts are arranged in rectilinear form so as to be connected to the to-be-connected terminals. The shape of the wire supporting part is not limited to the aforementioned one as long as the electric wires are supported so as to be led out in a longitudinal direction in which the terminal connection parts are arranged, and as long as the electric wires connected to the front-side connection terminals are supported so as to detour the periphery of the leading-side connection terminal.

In the above embodiment, a description was given of the electrical connecting device connected to the connecting housing element that supports the to-be-connected terminals of four poles. However, the present invention can be applied to to-be-connected terminals of five or more poles.

In the above embodiment, a description was given of a case in which the curved supporting part is formed of a step part having a plurality of steps and a curved wall surface. However, the present invention is not limited to this. For example, the curved supporting part may have only a step part having a plurality of steps without having a curved wall surface. Additionally, the curved supporting part may be formed of a slope part that has a slant surface, without such a step part having a plurality of steps. In this case, the formation of such a slope part having a slant surface makes it possible to arrange the electric wires while smoothly displacing its height in the insertion position. Additionally, the curved supporting part can be easily formed by a simple structure having such a slope part.

In the above embodiment, a description was given of a case in which the positioning part is formed on the cover element and on the front side of the connecting housing element. However, the present invention is not limited to this. For example, the positioning part may be provided only on the rear side, or may be provided both on the front side and on the rear side. In the above embodiment, a description was given of a case in which the groove is provided on the cover element side, and the elongated protrusion is provided on the connecting housing element side. However, these may be provided in a reverse manner. That is, the elongated protrusion may be provided on the cover element side, and the groove may be provided on the connecting housing element side. Alternatively, a plurality of elongated protrusions may be provided on the cover element side, and a plurality of grooves may be provided on the connecting housing element side.

As is clear from the above description, the electrical connecting device according to the present invention is applicable particularly to a case in which the electrical connecting device is used in such a way as to be first inserted into a hole formed to insert electric wires between the inside and outside of a vehicle and be then connected to a to-be-connected housing element. However, broader applications, in addition to this application, are possible for the present invention, and the present invention can be applied in a number of different environments and for a variety of purposes.

What is claimed is:

1. An electrical connecting device for connecting a to-be-connected housing element that supports to-be-connected terminals of three or more poles arranged in a parallel manner in rectilinear form, the electrical connecting device comprising:

a connecting housing element having terminal supporting parts and at least one wire supporting part, wherein the terminal supporting parts are aligned in a longitudinal direction of the connecting housing element;

connection terminals disposed on the connecting housing element, wherein each of the connection terminals comprises:

a terminal connection part disposed in one of the terminal supporting parts and configured to electrically connect one of the to-be-connected terminals;

a wire connection part configured to connect one of electric wires which extend substantially in the longitudinal direction along a surface of the connecting housing element; and a bent part disposed between the terminal connection part and the wire connection part, and wherein the at least one wire supporting part is configured to support a first electric wire connected to a first connection terminal such that the first electric wire extends around a bent part of a second connection terminal adjacent to the first connection terminal;

wherein the terminal supporting part supports the first connection terminal such that a direction of a wire connection part of the first connection terminal is angularly offset with respect to the longitudinal direction;

wherein the first electric wire is supported at different heights off the surface of the connecting housing element.

2. The electrical connecting device of claim 1, wherein the bent part is bent at a right angle.

3. The electrical connecting device of claim 1, wherein one of the wire supporting parts is a stacking supporting part that supports at least two electric wires in a stacked manner.

4. The electrical connecting device of claim 1, wherein one of the wire supporting parts is a curved supporting part disposed in proximity of the bend part of the second connection terminal, wherein a portion of the first electric wire extends along the curved supporting part.

5. The electrical connecting device of claim 4, further comprising a step part disposed in proximity to the curved supporting part and having a plurality of steps become higher step-by-step.

6. The electrical connecting device of claim 4, wherein the curved supporting part further comprises a curved wall surface to support the first electric wire.

7. The electrical connecting device of claim 1, wherein one of the wire supporting parts is a pair of projection parts, wherein the pair of projection parts is configured to support at least one of the electric wires therebetween.

8. The electrical connecting device of claim 7, wherein the pair of projection parts comprises an elongated rib each disposed on surfaces thereof that face each other, wherein the elongated rib has an arcuate surface.

9. The electrical connecting device of claim 1, further comprising a cover element configured to be attached to the connecting housing element so as to cover the connection terminals, wherein the cover element comprises a cover-side engagement part disposed on an inner surface of the cover element, and wherein the connecting housing element comprises a housing-side engagement part configured to engage the cover-side engagement part.

10. The electrical connecting device of claim 9, wherein the cover-side engagement part comprises a leg part that protrudes from the inner surface of the cover element and a latching part that protrudes from the leg part, wherein the housing-side engagement part comprises a hole part configured to engage the latching part.

11. The electrical connecting device of claim 1, further comprising a cover element configured to be attached to the connecting housing element so as to cover the connection terminals, wherein the cover element and the connecting housing element each have a positioning part configured to be engaged with each other.

12. The electrical connecting device of claim 11, wherein the positioning parts are configured with a complementary elongated protrusion and groove.

13. The electrical connecting device of claim 12, wherein a front part of the cover element is formed in a tapered shape and is formed to cover a front end of the connecting housing element where the positioning part is disposed.

14. The electrical connecting device of claim 1 that is used as an automotive part by inserting into a through-hole formed on a roof of a vehicle.

* * * * *